US006371722B1

(12) United States Patent
Takahashi

(10) Patent No.: US 6,371,722 B1
(45) Date of Patent: Apr. 16, 2002

(54) GAS SEALING APPARATUS FOR VARIABLE CAPACITY SUPERCHARGER

(75) Inventor: Yukio Takahashi, Sodegaura (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 0 days.

(21) Appl. No.: 09/524,383

(22) Filed: Mar. 13, 2000

(30) Foreign Application Priority Data

Mar. 11, 1999 (JP) ..... 11-065021

(51) Int. Cl.[7] ..... F01D 11/00
(52) U.S. Cl. ..... 415/113; 415/164; 415/174.2
(58) Field of Search ..... 415/164, 151, 415/159, 163, 110, 170.1, 173.1, 173.3, 174.2, 113

(56) References Cited

U.S. PATENT DOCUMENTS 3,565,449 A * 2/1971 Ascencio et al. ..... 277/235
4,009,972 A * 3/1977 Sarle ..... 417/407
4,181,313 A * 1/1980 Hillier et al. ..... 277/166

FOREIGN PATENT DOCUMENTS

JP 01-130002 5/1989

* cited by examiner

*Primary Examiner*—Edward K. Look
*Assistant Examiner*—Kimya McCoy
(74) *Attorney, Agent, or Firm*—Griffin & Szipl, P.C.

(57) ABSTRACT

A large number of nozzle vanes 16 are arranged in an annular channel 10 formed between opposed surfaces of turbine housing 1 and turbine shroud 9. A recess 20 is constructed on the formation surface of the annular channel 10 of the turbine housing 1, and in this recess, a clearance control plate 21 is disposed so that the clearance C between the plate and nozzle vanes 16 becomes constant. Two gaskets 25 whose outer rims are formed in a bead shape are laid in a gap S on the rear side of clearance control plate 21, in such a manner that outer rims of the gaskets separate from each other. In this configuration, outer rims widen when gas pressure is applied, and gas can be sealed stably without leakage.

2 Claims, 3 Drawing Sheets

GAS SEALING APPARATUS FOR VARIABLE CAPACITY SUPERCHARGER

This application claims priority on Japanese Patent Application Number 65021/1999, filed Mar. 11, 1999, the entire disclosure of which is incorporated herein by reference.

BACKGROUND OF THE INVENTION

1. Technical Field of the Invention

The present invention relates to a gas sealing apparatus for a variable capacity supercharger in which the flow of gas introduced can be adjusted.

2. Prior Art

Variable capacity superchargers in which a plurality of nozzle vanes are assembled, and by changing throats between aforementioned nozzle vanes, a flow of gas introduced into a turbine is controlled, have conventionally been widely used, as shown in FIG. 1, which depicts a typical sample. In detail, turbine housing 1 and compressor housing 2 are assembled into one body via bearing housing 3; turbine impeller 4 in turbine housing 1 and compressor impeller 5 in compressor housing 2 are connected with turbine shaft 7 supported rotatably by bearing 6 in bearing housing 3; annular turbine shroud 9 with gas discharge channel 9*a* formed on the inner periphery of the shroud is installed with bolts 8 on the inner periphery on the opposite side to bearing housing 3 of above-mentioned turbine housing 1; thus, annular flow channel 10 is formed between axially opposed surfaces of the outer periphery of above-mentioned turbine shroud 9 and the inner periphery of turbine housing 1 on the bearing housing 3 side; in addition, cover 12 provided with gas outlet 11 that communicates with gas discharge channel 9*a* of aforementioned turbine shroud 9 is installed with bolts 13 to the outer surface on the opposite side to bearing housing 3 in above-mentioned turbine housing 1; gas introduced from gas inlet 14 is led to turbine impeller 4 from scroll channel 15 equipped in turbine housing 1 via aforementioned annular channel 10; and the gas is discharged from gas outlet 11 through gas discharge channel 9*a*. In this configuration, many nozzle vanes 16 are arranged in annular gas channel 10 between aforementioned scroll channel 15 and the outer periphery of turbine impeller 4; one end of operating shaft 17 is fixed to above-mentioned nozzle vanes 16, and the other end of the shaft protrudes into torque transmission chamber 18 formed between turbine shroud 9 and cover 12 through the outer periphery of turbine shroud 9, and is connected to an actuator via transmission mechanism 19 of a link mechanism type; when the actuator operates, an opening or closing angle of nozzle vanes 16 can be varied; by controlling the opening or closing angle of nozzle vanes 16, throats between each nozzle vane 16 can be adjusted to be wide or narrow; thereby the flow of gas can be changed from a large to a small flow, and vice versa.

In addition, annular recess 20 is formed on the annular channel forming surface of turbine housing 1 with annular channel 10; inside above-mentioned recess 20, ring-shaped clearance control plate 21 is arranged on the wall surface of recess 20 with a predetermined gap S; the position of aforementioned clearance control plate 21, adjustable in the circumferential direction, is fixed by mounting shaft 22 installed on the outer periphery of turbine shroud 9, in which one surface of clearance control plate 21 acts as a surface forming the annular flow channel; thus clearance C to nozzle vanes 16 is maintained at a small constant value.

Although gap S on the rear side of aforementioned clearance control plate 21 is conceptually not necessary, it is actually provided because turbine housing 1 thermally deforms between cold and hot conditions, and there are variations in the accuracy of assembled component parts, however, if gas leaks from this gap S, engine performance at low speed greatly changes, resulting possibly in instability. In particular, when a large volume of gas leaks, nozzle vanes 16 slightly open, and the force for closing nozzle vanes 16 acts due to a pressure difference between upstream and downstream sides of nozzle vanes 16, so that gas flow can no longer be controlled normally.

Therefore, a supercharger for preventing gas leakage and absorbing thermal deformation of turbine housing 1 is proposed (unexamined Japanese patent publication No. 130002, 1989) as shown in FIG. 2; annular recess 20 with large piston ring 23 formed for sealing is mounted on the inner periphery of recess 20; guide annular portion 24 protruding on the rear surface of clearance control plate 21 is engaged with the outer periphery of above-mentioned piston ring 23 for sealing in an axially freely slidable manner; and because guide annular portion 24 engages with piston ring 23 for sealing, gas leakage is prevented and thermal deformation of the turbine housing is absorbed.

However, the apparatus disclosed in the above-mentioned unexamined Japanese patent publication No. 130002, 1989 relates to a large supercharger used for a ship, so the sealing piston ring 23 can be assembled in a space to the rear of clearance control plate 21, but a small supercharger used in a passenger car etc. cannot incorporate a piston ring system because of the limited space available.

SUMMARY OF THE INVENTION

An object of the present invention is, therefore, to provide a gas sealing apparatus that can also be adapted to a small supercharger and can reliably seal gas.

To solve the aforementioned problems, according to the present invention, annular turbine shroud (9) is arranged on the inner periphery of turbine housing (1), opposite to bearing housing (3); annular channel (10) is formed between axially opposite surfaces of the above-mentioned turbine shroud and the inner periphery of the turbine housing on the bearing housing side; a large number of nozzle vanes (16) whose opening or closing angle can be adjusted by rotating operating shaft (17) penetrating the outer periphery of the aforementioned turbine shroud, in the above-mentioned annular channel; annular recess (20) is structured on the formed surface of annular channel (10) of the aforementioned turbine housing; in the above-mentioned recess, ring-shaped clearance control plate (21) is fixed on and supported from the turbine shroud side; and clearance C between the front surface of the aforementioned clearance control plate and nozzle vanes is maintained at a predetermined value; in the gas sealing apparatus of a variable capacity supercharger thus constructed, gaskets (25) whose outer rims (25*a*) of the gaskets are shaped to separate from each other into the form of a round slot of which the section is shaped in the form of a U-shape, and disposed between the rear side of above-mentioned clearance control plate (21) and inner periphery of the bearing housing in turbine housing (1), and using gas pressure, the outer edges are widened and gas is sealed.

Because gaskets are shaped in the form of a U-shape, the gaskets can follow the thermal deformation of the turbine housing, due to the resilience of the gaskets, and at that time, because gas pressure acts to widen the outer rims of the gaskets, a pushing force can be maintained and stable sealing performance is achieved.

In addition, turbine shroud (9) is structured to insert in turbine housing (1) in the axial direction, and is installed on cover (12) of the outer surface of the turbine housing, and seal ring (27) shaped like a piston ring is placed in the axial engagement portion between the above-mentioned turbine shroud and turbine housing.

In this structure, thermal deformation of the turbine housing no longer directly affects the turbine shroud; in addition, leakage of gas from the insert portion between the turbine housing and the turbine shroud is suppressed by the seal ring.

Other objects and advantages of the present invention are revealed in the following description referring to the attached drawings.

DESCRIPTION OF PREFERRED EMBODIMENTS

Figure 1:
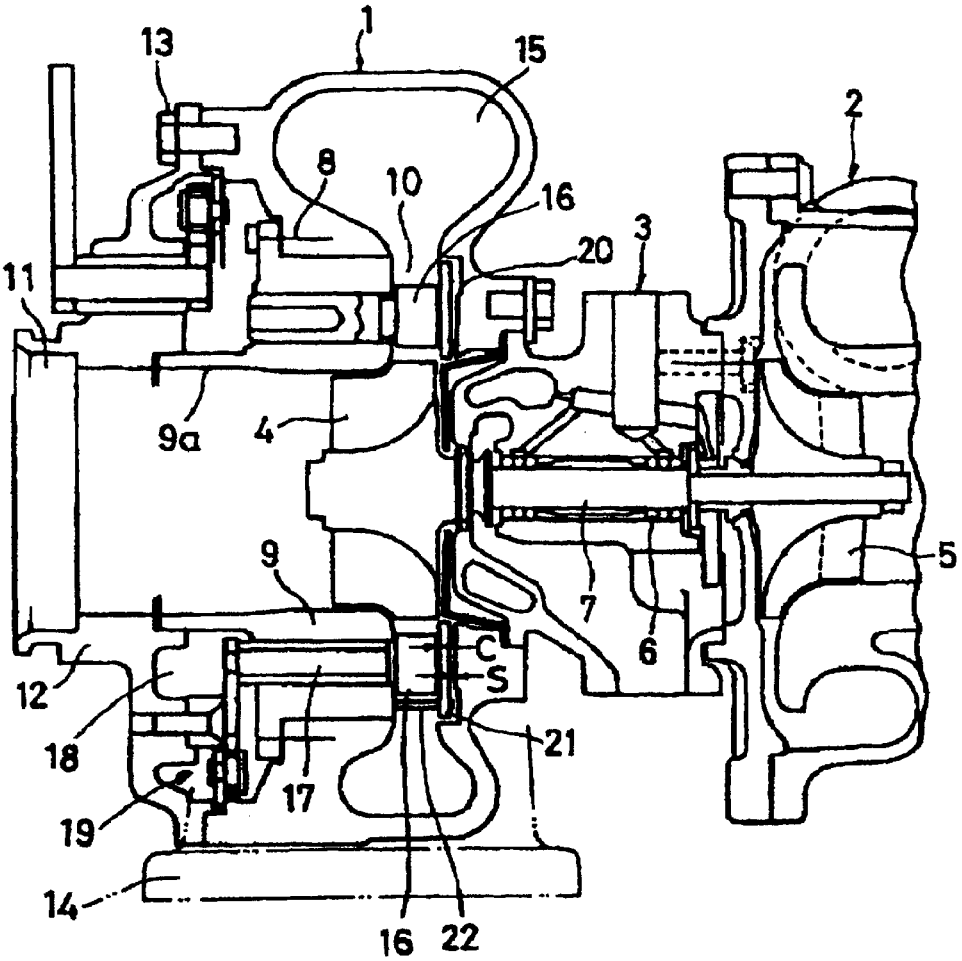
FIG.1 PRIOR ART
FIG. 1 is a general view of an example of a conventional variable capacity supercharger.
Figure 2:
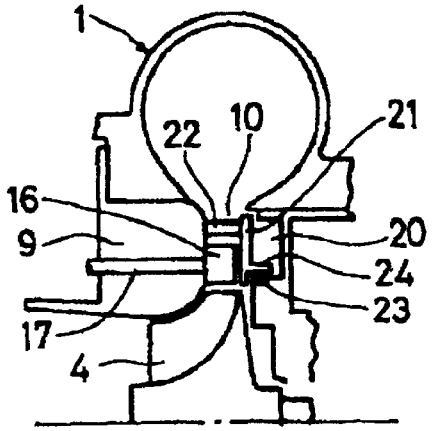
FIG.2 PRIOR ART
FIG. 2 is a partial view showing another example of a conventional variable capacity supercharger.

Embodiments of the present invention are described as follows referring to the drawings.

Figure 3A:
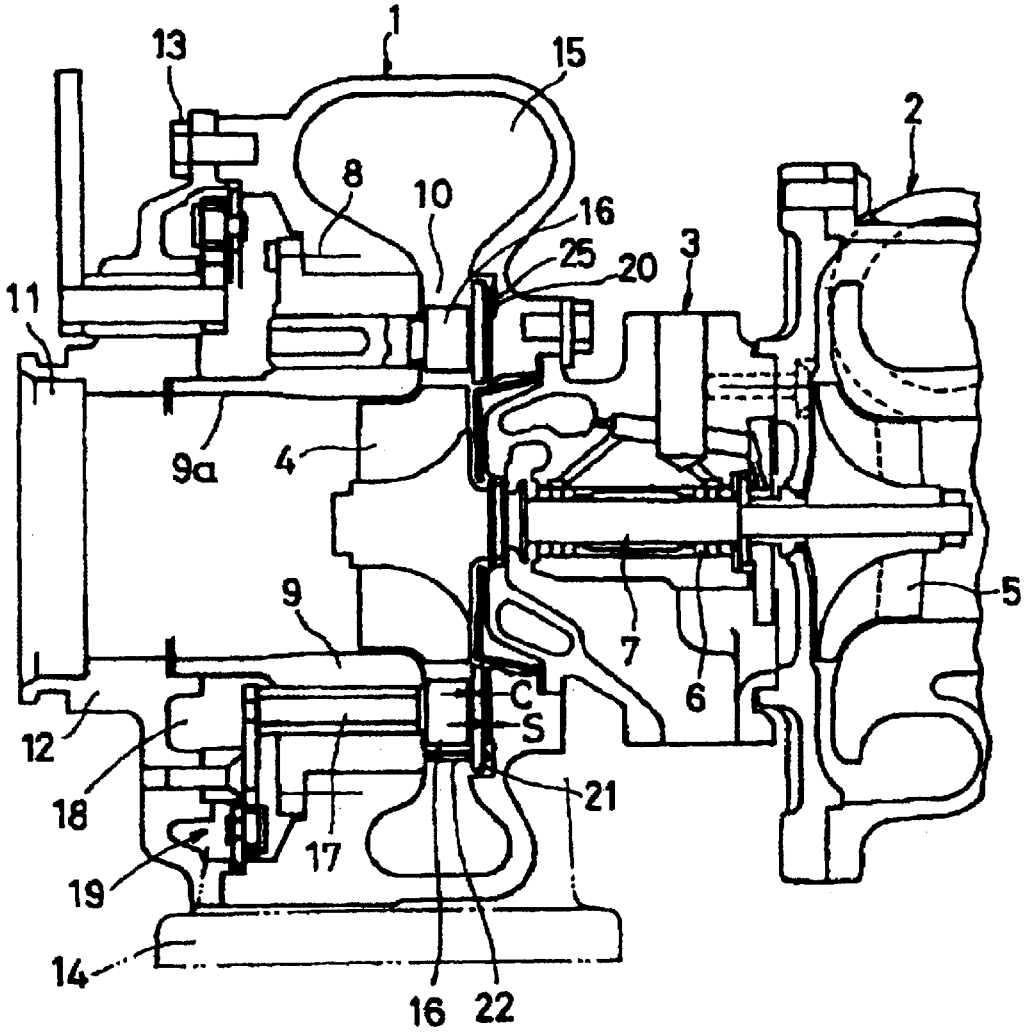
FIG. 3A is a general conceptual view of the first embodiment of the gas sealing apparatus for the variable capacity supercharger according to the present invention.
Figure 3B:
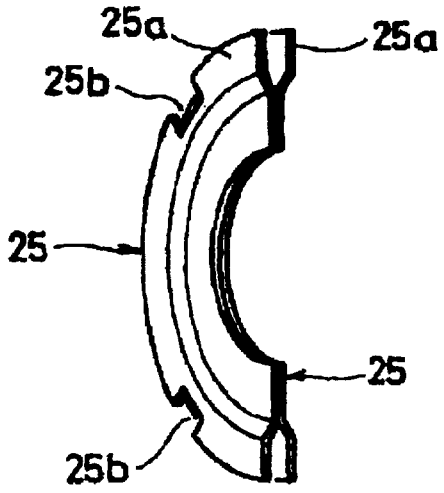
FIG. 3B is an enlarged view of a gasket of the first embodiment.

FIGS. 3A and 3B show the first embodiment of the present invention. In these figures, the gas sealing apparatus for a variable capacity supercharger according to the present invention is provided with annular turbine shroud 9 disposed on the inner periphery of turbine housing 1 on the opposite side to bearing housing 3; annular channel 10 is formed between surfaces of the outer periphery of aforementioned turbine shroud 9 and the inner periphery of turbine housing 1 on the side of bearing housing 3; a large number of nozzle vanes 16 are arranged in above-mentioned annular channel 10 in such a manner that the opening and closing angles of the vanes can be adjusted by rotating operating shaft 17 which penetrates the outer periphery of aforementioned turbine shroud 9; annular recess 20 is formed on the surface of the annular channel of above-mentioned turbine housing 1; ring-shaped clearance control plate 21 is arranged in and fixed at above-mentioned recess 20 by means of mounting shaft 22 supported by turbine shroud 9; thus clearance C between the front surface of aforementioned clearance control plate 21 and nozzle vanes 16 is maintained at a constant clearance.

Furthermore, in the gas sealing apparatus according to the present invention, two thin gaskets 25, formed into a bead shape (U-shape) at the outer rims 25*a* as shown enlarged in FIG. 3*b*, are superimposed and bonded together so that outer rims 25*a* are separate from each other, and the outer rim 25*a* of one gasket 25 is pressed to and fixed at the rear surface of clearance control plate 21, and the outer rim 25*a* of the other gasket 25 is fit on the wall surface of recess 20 of turbine housing 1, when pressure is applied. In FIG. 3B, numeral 25*b* represents cutaways provided at required positions in the outer rims 25*a* of gaskets 25 to avoid positions of mounting shafts 22 of clearance control plate 21.

The composition of the other component parts is the same as that shown in FIG. 1, and the same parts are represented by the same numbers.

Gap S between the rear surface of clearance control plate 21 and the wall surface of recess 20 widens and narrows depending on the thermal deformation of turbine housing 1. However, gaskets 25 disposed in this gap S as a set of two sheets are formed in a bead shape at the outer rims, and because outer rims 25*a* can resiliently deform, the gaskets can follow the aforementioned thermal deformation without problems, and deform accordingly. At that time, in addition, the pressure for gas to leak through gap S acts to widen outer opposite rims 25*a* of both gaskets 25, therefore, forces pressing one of outer rims 25*a* to the front surface of clearance control plate 21 and placing the other outer rim 25*a* to the wall surface of recess 20 can be maintained, so stable sealing performance is available. Because these pressing forces are not mechanical forces, clearance control plate 21 no longer contacts nozzle vanes 16.

Because leakage of gas from the rear side of aforementioned clearance control plate 21 can be prevented as described above, nozzle vanes 16 are always forced in the opening direction, so the controllability of the vanes can be improved.

A set of two gaskets 25 can be installed even in the small gap S above, therefore, the gaskets can be adapted even to a small supercharger without a marginal space, with no problems.

Figure 4:
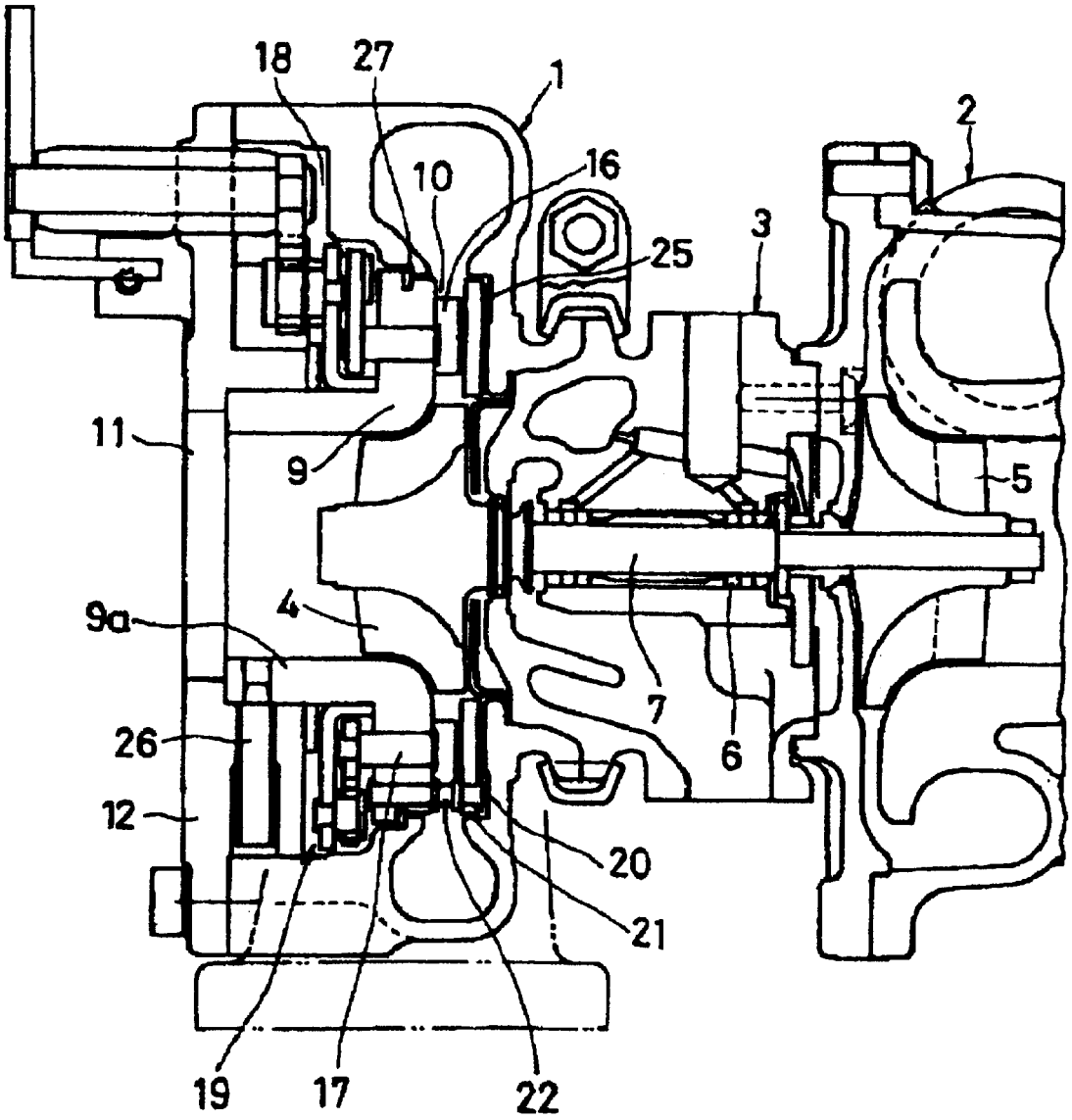
FIG. 4 is a conceptual view showing the second embodiment of the gas sealing apparatus according to the present invention.

Next, FIG. 4 shows the second embodiment of the gas sealing apparatus according to the present invention, whereby even when turbine housing 1 thermally deforms, the turbine shroud 9 side is protected from any direct effects. More explicitly, in the same configuration as shown in FIGS. 3A and 3B, above-mentioned turbine shroud 9 is structured in such a manner that the shroud is inserted in turbine housing 1 in the axial direction, and gas discharge channel 9*a* on the inner periphery of aforementioned turbine shroud 9 is mounted to and fixed at cover 12 on the outer surface of turbine housing 1, using fixing screw 26; in addition, seal ring 27 in a shape similar to a piston ring is equipped in the axial insert portion between above-mentioned turbine shroud 9 and turbine housing 1.

In the configuration of the embodiment shown in FIG. 4, because turbine shroud 9 is isolated from turbine housing 1, any thermal deformation of turbine housing 1 no longer directly affects turbine shroud 9. As a result, the thermal deformation of turbine shroud 9 also does not affect nozzle vanes 16 and clearance control plate 21, so that variations of aforementioned gap S become small and the gas sealing performance of gap S can be greatly stabilized.

Conversely, a gap is produced in the axial engagement portion between turbine shroud 9 and turbine housing 1, which may seem to cause gas leakage, however in actually, seal ring 27 in a shape like a piston ring can prevent gas from leakage. Therefore, any foreign matter such as soot contained in gas cannot intrude into torque transmission chamber 18, consequently, there is no such risk that transmission mechanism 19 fails due to deposition of foreign matter.

According to the gas sealing apparatus disclosed for a variable capacity supercharger in the present invention, the annular turbine shroud is disposed on the inner periphery of the turbine housing on the opposite side to the bearing housing, the annular channel is formed in the portion between axially opposed surfaces of the outer periphery of the aforementioned turbine shroud and the inner periphery of the turbine housing on the bearing housing side, and in the above-mentioned annular channel, a large number of nozzle vanes are arranged, and opening and closing angles of the vanes can be adjusted by rotating the operating shaft that penetrates the outer periphery of the aforementioned turbine shroud; in addition, the annular recess is formed on the surface to form the annular channel in the above-mentioned turbine housing, and in the aforementioned recess, the clearance control plate shaped like a ring is supported from and fixed at the turbine shroud side, thereby the clearance between the front surface of the aforementioned clearance control plate and nozzle vanes can be maintained constant in a variable capacity supercharger; between the rear side of the above-mentioned clearance control plate and the inner periphery of the turbine housing on the bearing housing side, a set of two gaskets whose outer rims are formed to separate from each other into a form whose section is U-shaped, and using gas pressure, the outer rims are pressurized outwards to seal the gas in this configuration.

Therefore, even if the turbine housing thermally deforms, gaskets can also follow the deformation due to the resilience thereof, and because gas pressure functions to widen outer rims of both gaskets, the gaskets can exert stable sealing properties.

Moreover, because thin gaskets can be used, they can be incorporated in a small supercharger without problems; in addition, since the turbine shroud is structured to insert in the turbine housing in the axial direction and is installed on the cover on the outer periphery of the turbine housing, and a seal ring shaped like a piston ring is placed in the axial engagement portion between the aforementioned turbine shroud and turbine housing, therefore, it is advantageous that thermal deformation of the turbine housing cannot directly affect the turbine shroud.

Also, another desirable effect that the present invention can provide is that the seal ring can suppress gas leakage from the engagement portion between the turbine shroud and the turbine housing.

Although the present invention is explained referring to several preferred embodiments, the scope of rights covered by the invention is understood not to be limited only to these embodiments. Instead, the scope of rights of the present invention includes all modifications, amendments, and equivalent entities as far as they are included in the scope of the attached claims.

What is claimed is:

1. In the gas sealing apparatus for a variable capacity supercharger, comprising a turbine housing (1), a bearing housing (3), an annular turbine shroud (9) arranged on the inner periphery of the said bearing housing, an annular channel (10) formed between axially opposed surfaces of the outer periphery of the said turbine shroud and the inner periphery of the said turbine housing on the bearing housing side, a large number of nozzle vanes (16) disposed in the said annular channel in such a manner that opening and closing angles of the nozzle vanes can be adjusted by rotating an operating shaft (10) that penetrates the outer periphery of the said turbine shroud, an annular recess (20) formed on the formation surface of the said annular channel (10) of the turbine housing, and a clearance control plate (21) shaped like a ring, and supported by, fixed at, and arranged on the turbine shroud side, in which a clearance C between the surface of the said clearance control plate, that faces the nozzle vanes, and the nozzle vanes can be maintained, gaskets (25) are disposed between the side of the said clearance control plate (21), opposite the said nozzle vanes, and the inner periphery of the turbine housing (1) on the bearing housing side, in such a manner that outer rims of the said gaskets are shaped to separate from each other, forming a round slot whose section is U-shaped, and when gas pressure is applied, the outer rims widen and seal the gas from leakage.

2. The gas sealing apparatus for a variable capacity supercharger, specified in claim 1, in which the turbine shroud (9) is structured to insert in the turbine housing (1) in the axial direction, and is installed on the cover (12) on the outer surface of the turbine housing, and a seal ring (27) is equipped in the axial engagement portion of the said turbine shroud and turbine housing.

* * * * *